US006641751B1

(12) United States Patent
Ooido et al.

(10) Patent No.: US 6,641,751 B1
(45) Date of Patent: Nov. 4, 2003

(54) MAGNETIC GARNET SINGLE CRYSTAL AND FARADAY ROTATOR USING THE SAME

(75) Inventors: Atsushi Ooido, Nihonbashi (JP); Kazuhito Yamasawa, Nihonbashi (JP)

(73) Assignee: TKD Corporation, Tokyo (JP)

( * ) Notice: Subject to any disclaimer, the term of this patent is extended or adjusted under 35 U.S.C. 154(b) by 350 days.

(21) Appl. No.: 09/625,417

(22) Filed: Jul. 25, 2000

(30) Foreign Application Priority Data

Aug. 2, 1999 (JP) ..... 11-218655
Aug. 2, 1999 (JP) ..... 11-218656

(51) Int. Cl.[7] ..... H01F 10/20
(52) U.S. Cl. ..... 252/62.57; 252/62.59; 252/62.58
(58) Field of Search ..... 117/945; 252/62.57, 252/62.58, 62.59

(56) References Cited

U.S. PATENT DOCUMENTS 6,309,557 B1 * 10/2001 Ooido et al. ..... 252/62.57
2002/0014612 A1 * 2/2002 Ohido et al. ..... 252/62.57

FOREIGN PATENT DOCUMENTS

JP A 61-265809 11/1986
JP A 2-232906 9/1990
JP 6-46604 6/1994
JP 06-302422 * 10/1994

OTHER PUBLICATIONS

Asahara et al., "growth of bismuth–substituted epitaxial garnet thick films for use in optical isolators", 1986.*
Asahara et al., "Growth of bismuth–substituted epitaxial garnet thick films for use in optical isolators", *Institute for Electronics and Communication Engineers of Japan*, 1986.

* cited by examiner

*Primary Examiner*—C. Melissa Koslow
(74) *Attorney, Agent, or Firm*—Oliff & Berridge, PLC

(57) ABSTRACT

The present invention relates to a magnetic garnet single crystal and a Faraday rotator using the magnetic garnet single crystal and the object of the present invention is to provide a magnetic garnet single crystal which suppresses a generation of crystal defects and a Faraday rotator which improves an extinction ratio.

A magnetic garnet single crystal grown by a liquid-phase epitaxial growth method and having the general formula represented by $$Bi_aPb_bA_{3-a-b}Fe_{5-c-d}B_cPt_dO_{12}$$

is used, wherein A is at least one kind of element selected from Y, La, Ce, Pr, Nd, Sm, Eu, Gd, Tb, Dy, Ho, Er, Tm, Yb and Lu, B is at least one kind of element selected from Ga, Al, Sc, Ge and Si, and a, b, c and d are represented by $0.8<a<1.4$, $0<b\leqq 20$, $0\leqq c\leqq 0.9$ and $0<d\leqq 2.0$ respectively.

11 Claims, No Drawings

MAGNETIC GARNET SINGLE CRYSTAL AND FARADAY ROTATOR USING THE SAME

BACKGROUND OF THE INVENTION

1. Field of the Invention

The present invention relates to a magnetic garnet single crystal and a Faraday rotator utilizing a magneto-optical effect which uses the magnetic garnet single crystal. The Faraday rotator using the magnetic garnet single crystal is used in a magneto-optical element such as, for example, an optical isolator, an optical circulator, an optical attenuator or the like.

2. Description of the Related Art

In an optical communication or an optical application device using semiconductor laser, an optical isolator, an optical circulator or an optical attenuator is widely used. The Faraday rotator can be cited as one of the essential elements for these devices.

Although a YIG (yttrium iron garnet) single crystal and a bismuth (Bi)-substituted rare earth iron garnet single crystal are known for the Faraday rotator, at present, the Faraday rotator using a bismuth-substituted rare earth iron garnet single crystal film formed by a liquid-phase epitaxial (LPE) method is the mainstream.

For example, in the Japanese Patent Publication No. 6-46604, a bismuth-substituted rare earth iron garnet is described. The bismuth-substituted rare earth iron garnet which is grown by a liquid-phase epitaxial growth method has a composition expressed by a general formula $R_{3-(a+b)}Pb_aBi_bFe_{5-c}M_cO_{12-d}$ (R is at least one kind of element selected from rare earth elements and elements substitutable with the rare earth elements, M is at least one kind of element selected from elements substitutable with iron elements, a is a number between 0.01 and 0.2, b is a number between 0.5 and 2.0, c is a number between 0.01 and 2.0 and d is a number between 0 and 1). At the same time, a part of M in the aforementioned formula contains a tetravalent element which is belonging to the Group IVA and the Group IVB in the periodic table excluding Pb in which tetravalent element is more than 0.01 as an atomic ratio (c) in the above general chemical formula.

As disclosed in the above publication, $Pb^{4+}$ can be eliminated when the Bi-substituted rare earth iron garnet single crystal is grown by the liquid-phase epitaxial method by adding an IV Group element. Therefore, an absorption loss at the time of transmitting light through the Bi-substituted rare earth iron garnet single crystal can be reduced.

By the way, as shown in the example disclosed in the Japanese Patent Publication No. 6-46604, if for example $TiO_2$ is added as the IV Group element and a single crystal epitaxial film is grown by the liquid-phase epitaxial method, an effect of reducing the light absorption loss of the obtained Bi-substituted rare earth iron garnet single crystal epitaxial film is recognized. However, when the film thickness of the obtained epitaxial film is more than approximately 200 $\mu$m, many crystal defects are confirmed on a film surface. When the Faraday rotator for an optical isolator is fabricated by polishing the surface of such a crystal and forming a non-reflective film, many defects are confirmed in the interior of the Faraday rotator according to an observation using the infrared ray and a reduction of the extinction ratio is also identified.

The invention described in the Japanese Patent Publication No. 6-46604 cites a reduction of the light absorption loss of the Bi-substituted rare earth iron garnet single crystal epitaxial film as a technical subject and none is disclosed with respect to the subject to suppress the generation of crystal defects and to improve the extinction ratio. If the generation of crystal defects in the Bi-substituted rare earth iron garnet single crystal epitaxial film can be suppressed, the extinction ratio of the Faraday rotator can be improved and furthermore, the performance of optical communication parts including the optical isolator can be improved by improving the extinction ratio of the Faraday rotator.

SUMMARY OF THE INVENTION

An object of the present invention is to provide a magnetic garnet single crystal which reduces an absorption loss by adding a tetravalent element and then suppresses a generation of crystal defects.

Another object of the present invention is to provide a Faraday rotator which reduces an insertion loss and improves an extinction ratio.

Therefore, the inventors of the present invention investigate to obtain a single crystal more than approximately 200 $\mu$m which is required to fabricate the Faraday rotator without generating many crystal defects as well as additives for achieving a reduction in light absorption.

As a result, it is found that a remarkable effect is achieved if Pt which can steadily take a tetravalent structure similar to the structure of the IV Group elements is used as an additional element. In other words, when $PtO_2$ or Pt is melted in the flux and a Bi-substituted rare earth iron garnet single crystal which is more than 200 $\mu$m in film thickness is grown, the number of crystal defects on the epitaxial film surface is considerably reduced, no crystal defect is confirmed even if the single crystal is observed by the polarization microscope using the infrared ray, and the light absorption loss can be substantially naught (zero).

Further, it is found that if Ge is used as an additional element, a remarkable effect is achieved. In other words, when $GeO_2$ is added and the Bi-substituted rare earth iron garnet single crystal which is more than 200 $\mu$m in film thickness is grown, the number of crystal defects on the epitaxial film surface is considerably reduced, no crystal defect is confirmed either according to the observation of the interior of the single crystal by the polarization microscope using the infrared ray, and the light absorption loss can be substantially naught (zero).

The above objects are achieved by a magnetic garnet single crystal which is grown by the liquid-phase epitaxial growth method and expressed by a general formula $Bi_aPb_bA_{3-a-b}Fe_{5-c-d}B_cPt_dO_{12}$ (A in the formula is at least one kind of element selected from Y, La, Ce, Pr, Nd, Sm, Eu, Gd, Tb, Dy, Ho, Er, Tm, Yb and Lu, B is at least one kind of element selected from Ga, Al, Sc, Ge and Si and a, b, c and d are $0.8<a<1.4$, $0<b\leqq 2.0$, $0\leqq c\leqq 0.9$ and $0<d\leqq 2.0$ respectively).

In the above magnetic garnet single crystal according to the present invention, the film thickness is more than 200 $\mu$m. Further, in the above magnetic garnet single crystal according to the present invention, $0.5\leqq b/d\leqq 2.0$ is realized.

Furthermore, the above objects are achieved by a magnetic garnet single crystal which is grown by the liquid-phase epitaxial growth method and expressed by the general formula $Bi_aPb_bA_{3-a-b}Fe_{5-c-d}B_cGe_dO_{12}$ (A in the formula is at least one kind of element selected from Y, La, Ce, Pr, Nd, Sm, Eu, Gd, Tb, Dy, Ho, Er, Tm, Yb and Lu, B is at least one kind of element selected from Ga, Al, Sc, Pt and Si and a, b, c and d are $0<a<3.0$, $0<b\leqq 2.0$, $0\leqq c\leqq 2.0$ and $0<d\leqq 2.0$ respectively).

In the above magnetic garnet single crystal according to the present invention, the film thickness is more than 200 μm.

Further, the above objects are achieved by a Faraday rotator which is formed from the above magnetic garnet single crystal according to the present invention. Furthermore, an insertion loss of the Faraday rotator according to the present invention is less than 0.1 dB.

An operation of the present invention is described below. $Ti^{4+}$, $Pt^{4+}$ or $Ge^{4+}$ is mainly substituted to an Fe site of a 6-coordination in a lattice of the Bi-substituted rare earth iron garnet. However, since an ion radius of $Ti^{4+}$ is larger than that of $Fe^{3+}$ in the 6-coordination, a distortion is generated in the lattice of the Bi-substituted rare earth iron garnet. Therefore, when the epitaxial growth progresses and the film thickness increases, the distortion in the lattice is accumulated and many crystal defects generate. Since the ion radius of $Pt^{4+}$ or $Ge^{4+}$ is smaller than that of $Fe^{3+}$ in the coordination 6, a distortion is not generated in the lattice of the garnet and even when the thickness of the epitaxial film increases, no crystal defect generates. When the Faraday rotator having a Faraday rotational angle of 45 degrees in light equal to 1.31 μm and 1.55 μm in wavelength is fabricated by using the single crystal which substitutes $Fe^{3+}$ with this $Pt^{4+}$ or $Ge^{4+}$, no defect in the crystal interior is confirmed and no irregularities in the extinction ratio such as being less than 40 dB are generated. A similar effect to such effects of $PtO_2$ and Pt as additives can be also expected when other Pt compound is used. Further, a similar effect to the effect of $GeO_2$ as an additive can be also expected when other Ge compound is used.

Further, the a indicates the amount of Bi in the magnetic garnet in the magnetic garnet single crystal according to the present invention. The Bi amount a is a factor to determine a rotational capacity (deg./μm) of the Faraday rotator and the greater the Bi amount a is, the more the Faraday rotational capacity increases. A preferable Bi amount a of the magnetic garnet single crystal when used as the Faraday rotator is equal to approximately 0.6 to 1.5. When the Bi amount a is less than 0.6, the Faraday rotational capacity is too small and when the Bi amount a is more than 1.5, a deposition of a phase other than garnet occurs, thereby generating a possibility in which normally the magnetic garnet can not epitaxially grow. However, in the present condition, the magnetic garnet which is less than 0.6 in Bi amount a can be experimentally fabricated. Further, the magnetic garnet which Bi amount a is 3.0 can be also obtained by using a vacuum deposition technique. Therefore, the Bi amount a of the magnetic garnet single crystal for fabricating the Faraday rotator is established to be $0<a<3.0$ in the present invention.

The b indicates the amount of Pb in the magnetic garnet. Since the garnet which is at least substantially 2.0 in Pb amount b can exist in the state of a sintered body, $0<b\leqq 2.0$ is established in the present invention.

The c indicates the amount of nonmagnetic elements such as Ca, Al and the like which can be substituted for Fe. If the nonmagnetic element amount c exceeds approximately 2.0, the magnetic garnet turns from a ferrimagnetic body into a paramagnetic body, the Faraday rotational capacity is considerably reduced, thereby making impossible to be used as a rotator. Therefore, the nonmagnetic element amount c is established to be $0<c\leqq 2.0$ in the present invention.

The d indicates the amount of Pt or Ge. Since the amount of Pb which is a divalent element and the amount d of Pt or Ge which is a tetravalent element are required to be substantially the same in order to reduce the light absorption loss, the Pt or Ge amount d is established to be $0<d\leqq 2.0$ similarly to the Pb amount.

Further, $0.5\leqq b/d\leqq 2.0$ is desirable for Pt owing to the relation with the light absorption loss (insertion loss). For example, since the Pb amount b is equal to 0.04 and the Pt amount d is also equal to 0.04 in Example 1 described later, (Pb amount b)/(Pt amount d)=1 is realized. The insertion loss of the Faraday rotator is from 0.01 to 0.05 dB at this time. Furthermore, for example, since the Pb amount b is equal to 0.04 and the Pt amount d is equal to 0.02 in Example 2, (Pb amount b)/(Pt amount d)=2 is realized. The insertion loss of the Faraday rotator at this time is from 0.06 to 0.10 dB. The value generally required as the insertion loss of the Faraday rotator for an optical isolator is 0.10 dB. The insertion loss is smallest in a composition in which the Pb amount b is in accordance with the Pt amount d, and as the ratio between the Pb amount b and the Pt amount d are different, the insertion loss increases. Therefore, in order to satisfy the generally required value for the insertion loss of 0.10 dB, a condition of $0.5\leqq b/d\leqq 2.0$ is required.

DESCRIPTION OF THE PREFERRED EMBODIMENTS

In the embodiment of the present invention, a Bi-substituted rare earth iron garnet single crystal film which contains Pt or Ge and is more than 200 μm in film thickness is grown from flux containing Pb. By using the obtained Bi-substituted rare earth iron garnet single crystal film, a Faraday rotator which is low in light absorption loss and crystal defects and high in extinction ratio can be fabricated with stability.

EXAMPLES

[Example 1] through [Example 7] are described below as specific examples of a magnetic garnet single crystal according to the present invention and as a rotator using the magnetic garnet single crystal thereof as well as comparative examples.

Example 1

After materials which are $Yb_2O_3$ (weight: 6.747 g), $Gd_2O_3$ (weight: 6.624 g), $B_2O_3$ (weight: 43.214 g), $Fe_2O_3$ (weight: 144.84 g), PbO (weight: 1189.6 g), $Bi_2O_3$ (weight: 826.4 g) and $PtO_2$ (weight: 5.121 g) were filled in a crucible made of Pt, fused at approximately 1000° C., stirred and homogenized, the temperature was reduced at 120° C./h (hour) and stabilized in a super saturation state at 820° C. Then, while a (Ca, Mg, Zr)-substituted gadolinium gallium garnet (hereinafter, referred to as GGG) single crystal substrate having a size of 2 inches in diameter was rotated at 100 rotations/minute (r.p.m.), the magnetic garnet single crystal film was epitaxially grown and the single crystal film having film thickness equal to 505 μm was obtained.

The surface of this magnetic garnet single crystal film was in a mirror state, and when a number of crystal defects on the surface was evaluated, 10 crystal defects were confirmed on the single crystal film having a diameter equal to 2 inches and no crack was generated on the single crystal film. When a composition of the single crystal film obtained by a fluorescent X-ray method was analyzed, the composition was $Bi_{1.12}Gd_{1.15}Yb_{0.69}Pb_{0.04}Fe_{4.96}PtO_{0.04}O_{12}$. Further, this magnetic garnet single crystal film was polished by light having a wavelength of 1.55 μm so that a Faraday rotational angle was 45 deg., non-reflective films were attached on both surfaces, and the Faraday rotator for the wavelength equal to 1.55 μm was fabricated.

When the internal crystal defects, Faraday rotational capacity, insertion loss, temperature characteristic and extinction ratio were evaluated after this Faraday rotator was cut into 3-mm squares, no defect was confirmed in the observation by a polarization microscope using the infrared ray, and a Faraday rotational coefficient of 0.113 deg./μm, a maximum insertion loss of 0.05 dB, a minimum insertion loss of 0.01 dB, a temperature characteristic of 0.067 deg./°C./, a maximum extinction ratio of 45.6 dB and a minimum extinction ratio of 42.1 dB were obtained when the film thickness was equal to 400 μm (refer to Table 1).

In this Example 1, the insertion loss of the Faraday rotator was from 0.01 to 0.05 dB and a standard desired value which is less than 0.10 dB in insertion loss was satisfied. Since the Pb amount b was equal to 0.04 and the Pt amount d was equal to 0.04 at this time, (Pb amount b)/(Pt amount d)=1 was confirmed and was in the range of $0.5 \leqq b/d \leqq 2.0$.

Example 2

After materials which are $Yb_2O_3$ (weight: 6.747 g), $Gd_2O_3$ (weight: 6.624 g), $B_2O_3$ (weight: 43.214 g), $Fe_2O_3$ (weight: 144.84 g), PbO (weight: 1189.6 g), $Bi_2O_3$ (weight: 826.4 g) and $PtO_2$ (weight: 2.556 g) were filled in a crucible made of Pt, fused at approximately 1000° C., stirred and homogenized, the temperature was reduced at 120° C./h (hour) and stabilized in a super saturation state at 820° C. Then, while a (Ca, Mg, Zr)-substituted GGG single crystal substrate having a diameter equal to 2 inches was rotated at 100 r.p.m., the magnetic garnet single crystal film was epitaxially grown and the single crystal film which is equal to 500 μm in film thickness was obtained.

The surface of this magnetic garnet single crystal film was in a mirror state, and when the number of crystal defects on the surface was evaluated, 15 crystal defects were confirmed on the single crystal film having a diameter equal to 2 inches and no crack was generated on the single crystal film. When the composition of the single crystal film obtained by a fluorescent X-ray method was analyzed, the composition was $Bi_{1.12}Gd_{1.15}Yb_{0.69}Pb_{0.04}Fe_{4.98}PtO_{0.02}O_{12}$. Further, this magnetic garnet single crystal film was polished by light having a wavelength of 1.55 μm so that a Faraday rotational angle was 45 deg., non-reflective films were attached on both surfaces, and the Faraday rotator for the wavelength equal to 1.55 μm was fabricated.

When the internal crystal defects, Faraday rotational capacity, insertion loss, a temperature characteristic and extinction ratio were evaluated after this Faraday rotator was cut into 3-mm squares, no defect was confirmed in an observation by a polarization microscope using the infrared ray, a Faraday rotational coefficient of 0.113 deg./μm, a maximum insertion loss of 0.10 dB, a minimum insertion loss of 0.06 dB, a temperature characteristic of 0.064 deg./°C./, a maximum extinction ratio of 44.9 dB and a minimum extinction ratio of 41.6 dB were obtained when the film thickness was equal to 400 μm (refer to Table 1).

In this Example 2, the insertion loss of the Faraday rotator was from 0.06 to 0.10 dB and a standard desired value which is less than 0.10 dB in insertion loss was satisfied. Since the Pb amount b was equal to 0.04 and the Pt amount d was equal to 0.02 at this time, (Pb amount b)/(Pt amount d)=2 was confirmed and was in the range of $0.5 \leqq b/d \leqq 2.0$.

Example 3

After materials which are $Yb_2O_3$ (weight: 10.677 g), $Gd_2O_3$ (weight: 7.403 g), $B_2O_3$ (weight: 48.68 g), $Fe_2O_3$ (weight: 205.58 g), PbO (weight: 430.5 g) and $Bi_2O_3$ (weight: 1605.8 g) were filled in a crucible made of Pt, fused at approximately 1050° C., stirred and homogenized, the temperature was reduced at 120° C./h and stabilized in a super saturation state at 885° C. Then, while a (Ca, Mg, Zr)-substituted GGG single crystal substrate having a diameter equal to 2 inches was rotated at 100 r.p.m., the magnetic garnet single crystal film was epitaxially grown and the single crystal film which is equal to 620 μm in film thickness was obtained.

The surface of this magnetic garnet single crystal film was in a mirror state, and when the number of crystal defects on the surface was evaluated, 18 crystal defects were confirmed on the single crystal film having a diameter equal to 2 inches and no crack was generated on the single crystal film. When the composition of the single crystal film obtained by a fluorescent X-ray method was analyzed, the composition was $Bi_{1.16}Gd_{1.08}Yb_{0.72}Pb_{0.04}Fe_{4.97}PtO_{0.03}O_{12}$. Pt contained in the magnetic garnet was the Pt eluted from the crucible made of Pt into the flux containing Pb. Further, this magnetic garnet single crystal film was polished by light having a wavelength of 1.31 μm so that a Faraday rotational angle was 45 deg., non-reflective films were attached on both surfaces, and the Faraday rotator for the wavelength equal to 1.31 μm was fabricated.

When the internal crystal defects, Faraday rotational coefficient, insertion loss, a temperature characteristic and extinction ratio were evaluated after this Faraday rotator was cut into 3-mm squares, no defect was confirmed in the observation by a polarization microscope using the infrared ray, and a Faraday rotational coefficient of 0.188 deg./μm, a maximum insertion loss of 0.07 dB, a minimum insertion loss of 0.03 dB, a temperature characteristic of 0.064 deg./°C./, a maximum extinction ratio of 45.6 dB and a minimum extinction ratio of 41.9 dB were obtained when the film thickness was equal to 240 μm (refer to Table 1).

In this Example 3, the insertion loss of the Faraday rotator was from 0.03 to 0.07 dB and a standard desired value which is less than 0.10 dB in insertion loss was satisfied. Since the Pb amount b was equal to 0.04 and the Pt amount d was equal to 0.03 at this time, (Pb amount b)/(Pt amount d)=1.33 was confirmed and was in the range of $0.5 \leqq b/d \leqq 2.0$.

Example 4

After materials which are $Yb_2O_3$ (weight: 8.434 g), $Gd_2O_3$ (weight: 5.300 g), $B_2O_3$ (weight: 43.214 g), $Fe_2O_3$ (weight: 144.84 g), PbO (weight: 1189.6 g), $Bi_2O_3$ (weight: 826.4 g) and $PtO_2$ (weight: 5.121 g) were filled in a crucible made of Pt, fused at approximately 1000° C., stirred and homogenized, the temperature was reduced at 120° C./h and stabilized in a super saturation state at 804° C. Then, while a (Ca, Mg, Zr)-substituted GGG single crystal substrate having a diameter equal to 2 inches was rotated at 100 r.p.m., the magnetic garnet single crystal film was epitaxially grown and the single crystal film which is equal to 360 μm in film thickness was obtained.

The surface of this magnetic garnet single crystal film was in a mirror state, and when the number of crystal defects on the surface was evaluated, 10 crystal defects were confirmed on the single crystal film having a diameter equal to 2 inches and no crack was generated on the single crystal film. When the composition of the single crystal film obtained by a fluorescent X-ray method was analyzed, the composition was $Bi_{1.30}Gd_{0.90}Yb_{0.76}Pb_{0.04}Fe_{4.96}Pt_{0.04}O_{12}$. Further, this magnetic garnet single crystal film was polished by light having a wavelength of 1.31 μm so that a Faraday rotational angle was 45 deg., non-reflective films were attached on both surfaces, and the Faraday rotator for the wavelength equal to 1.31 μm was fabricated.

When the internal crystal defects, Faraday rotational coefficient, insertion loss, a temperature characteristic and extinction ratio were evaluated after this Faraday rotator was cut into 3-mm squares, no defect was confirmed in an observation by a polarization microscope using the infrared ray, a Faraday rotational coefficient of 0.225 deg./μm, a maximum insertion loss of 0.04 dB, a minimum insertion loss of 0.01 dB, a temperature characteristic of 0.063 deg./°C./, a maximum extinction ratio of 45.7 dB and a minimum extinction ratio of 42.1 dB were obtained when a film thickness was equal to 200 μm (refer to Table 1).

In this Example 4, the insertion loss of the Faraday rotator was from 0.01 to 0.04 dB and a standard desired value which was less than 0.10 dB in insertion loss was satisfied. Since the Pb amount b was equal to 0.04 and the Pt amount d was equal to 0.04 at this time, (Pb amount b)/(Pt amount d)=1 was confirmed and was in the range of $0.5 \leqq b/d \leqq 2.0$.

Comparative Example

After materials which are $Yb_2O_3$ (weight: 8.434 g), $Gd_2O_3$ (weight: 5.300 g), $B_2O_3$ (weight: 43.214 g), $Fe_2O_3$ (weight: 144.84 g), PbO (weight: 1189.6 g), $Bi_2O_3$ (weight: 826.4 g) and $TiO_2$ (weight: 1.810 g) were filled in a crucible made of Pt, fused at approximately 1000° C., stirred and homogenized, the temperature was reduced at 120° C./h and stabilized in a super saturation state at 804° C. Then, while a (Ca, Mg, Zr)-substituted GGG single crystal substrate having a diameter equal to 2 inches was rotated at 100 r.p.m., the magnetic garnet single crystal film was epitaxially grown and the single crystal film which is equal to 355 μm in film thickness was obtained.

The surface of this magnetic garnet single crystal film was turbid, and when the number of crystal defects on the surface was evaluated, 166 crystal defects were confirmed on the single crystal film having a diameter equal to 2 inches and no crack was generated on the single crystal film. When the composition of the single crystal film obtained by a fluorescent X-ray method was analyzed, the composition was confirmed to be $Bi_{1.30}Gd_{0.90}Yb_{0.76}Pb_{0.04}Fe_{4.96}Pt_{0.01}Ti_{0.03}O_{12}$. Further, this magnetic garnet single crystal film was polished by light having a wavelength of 1.31 μm so that a Faraday rotational angle was 45 deg., non-reflective films were attached on both surfaces, and the Faraday rotator for the wavelength equal to 1.31 μm was fabricated.

When the internal crystal defects, Faraday rotational coefficient, insertion loss, a temperature characteristic and extinction ratio were evaluated after this Faraday rotator was cut into 3-mm squares, one or two defects were confirmed in the observation by a polarization microscope using the infrared ray, and a Faraday rotational coefficient of 0.225 deg./μm, a maximum insertion loss of 0.04 dB, a minimum insertion loss of 0.02 dB, a temperature characteristic of 0.063 deg./°C./, a maximum extinction ratio of 38.9 dB and a minimum extinction ratio of 36.9 dB were obtained when a film thickness was equal to 200 μm (refer to Table 1).

In this Comparative Example, the insertion loss of the Faraday rotator was from 0.02 to 0.04 dB and a standard desired value which was less than 0.10 dB in insertion loss was satisfied. This is because this Comparative Example was included in the invention disclosed in the above Japanese Patent Publication 6-46604.

Example 5

After materials which are $Yb_2O_3$ (weight: 6.747 g), $Gd_2O_3$ (weight: 6.624 g), $B_2O_3$(weight: 43.214 g), $Fe_2O_3$ (weight: 144.84 g), PbO (weight: 1189.6 g), $Bi_2O_3$ (weight: 826.4 g) and $GeO_2$ (weight: 2.360 g) were filled in a crucible made of Pt, fused at approximately 1000° C., stirred and homogenized, the temperature was reduced at 120° C./h (hour) and stabilized in a super saturation state at 820° C. Then, while a (Ca, Mg, Zr)-substituted GGG single crystal substrate having a diameter equal to 2 inches was rotated at 100 rotations/minute (r.p.m.), the magnetic garnet single crystal film was epitaxially grown, and the single crystal film which was equal to 495 μm in film thickness was obtained.

The surface of this magnetic garnet single crystal film was in a mirror state, and when the number of crystal defects on the surface was evaluated, 12 crystal defects were confirmed on the single crystal film having a diameter equal to 2 inches and no crack was generated on the single crystal film. When the composition of the single crystal film obtained by a fluorescent X-ray method was analyzed, the composition was $Bi_{1.12}Gd_{1.15}Yb_{0.69}Pb_{0.04}Fe_{4.96}Pt_{0.01}Ge_{0.03}O_{12}$. Further, this magnetic garnet single crystal film was polished by light having a wavelength of 1.55 μm so that a Faraday rotational angle was 45 deg., non-reflective films were attached on both surfaces, and the Faraday rotator for the wavelength equal to 1.55 μm was fabricated.

When the internal crystal defects, Faraday rotational capacity, insertion loss, a temperature characteristic and extinction ratio were evaluated after this Faraday rotator was cut into 3-mm squares, no defect was confirmed in the observation by a polarization microscope using the infrared ray, and a Faraday rotational coefficient of 0.113 deg./μm, a maximum insertion loss of 0.05 dB, a minimum insertion loss of 0.01 dB, a temperature characteristic of 0.067 deg./°C./, a maximum extinction ratio of 45.1 dB and a minimum extinction ratio of 42.0 dB were obtained when a film thickness was equal to 400 μm (refer to Table 2).

Example 6

After $Tb_2O_3$ (weight: 14.110 g), $B_2O_3$ (weight: 46.45 g), $Fe_2O_3$ (weight: 148.82 g), PbO (weight: 1054.4 g), $Bi_2O_3$ (weight: 965.8 g) and $GeO_2$ (weight: 2.522 g) were filled in a crucible made of Pt, fused at approximately 1000° C., stirred and homogenized, the temperature was reduced at 120° C./h and stabilized in a super saturation state at 8.33° C. Then, while a (Ca, Mg, Zr)-substituted GGG single crystal substrate having a diameter equal to 2 inches was rotated at 100 r.p.m., the magnetic garnet single crystal film was epitaxially grown and the single crystal film which was equal to 460 μm in film thickness was obtained.

The surface of this magnetic garnet single crystal film was in a mirror state, and when the number of crystal defects on the surface was evaluated, 15 crystal defects were confirmed on the single crystal film having a diameter equal to 2 inches and no crack was generated on the single crystal film. When the composition of the single crystal film obtained by a fluorescent X-ray method was analyzed, the composition was $Bi_{0.08}Tb_{2.16}Pb_{0.04}Fe_{4.96}Pt_{0.01}Ge_{0.03}O_{12}$. Further, this magnetic garnet single crystal film was polished by light having a wavelength of 1.31 μm so that a Faraday rotational angle was 45 deg., non-reflective films were attached on both surfaces, and the Faraday rotator for the wavelength equal to 1.31 μm was fabricated.

When the internal crystal defects, Faraday rotational capacity, insertion losses, a temperature characteristic and extinction ratios were evaluated after this Faraday rotator was cut into 3-mm squares, no defect was confirmed in the observation by a polarization microscope using the infrared ray, and a Faraday rotational coefficient of 0.128 deg./$\mu$m, a maximum insertion loss of 0.05 dB, a minimum insertion loss of 0.02 dB, a temperature characteristic of 0.037 deg./°C./, a maximum extinction ratio of 45.8 dB and a minimum extinction ratio of 42.8 dB were obtained when a film thickness was equal to 352 $\mu$m (refer to Table 2).

Example 7

After materials which are $Yb_2O_3$ (weight: 8.434 g), $Gd_2O_3$ (weight: 5.300 g), $B_2O_3$ (weight: 43.214 g), $Fe_2O_3$ (weight: 144.84 g), PbO (weight: 1189.6 g), $Bi_2O_3$ (weight: 826.4 g) and $GeO_2$ (weight: 2.360 g) were filled in a crucible made of Pt, fused at approximately 1000° C., stirred and homogenized, the temperature was reduced at 120° C./h and stabilized in a super saturation state at 804° C. Then, while a (Ca, Mg, Zr)-substituted GGG single crystal substrate having a diameter equal to 2 inches was rotated at 100 r.p.m., the magnetic garnet single crystal film was epitaxially grown and the single crystal film which is equal to 350 $\mu$m in film thickness was obtained.

The surface of this magnetic garnet single crystal film was in a mirror state, and when the number of crystal defects on the surface was evaluated, 10 crystal defects were confirmed on the single crystal film having a diameter equal to 2 inches and no crack was generated on the single crystal film. When the composition of the single crystal film obtained by a fluorescent X-ray method was analyzed, the composition was $Bi_{1.30}Gd_{0.09}Yb_{0.76}Pb_{0.04}Fe_{4.96}Pt_{0.01}Ge_{0.03}O_{12}$. Further, this magnetic garnet single crystal film was polished by light having a wavelength of 1.31 $\mu$m so that a Faraday rotational angle was 45 deg., non-reflective films were attached on both surfaces, and the Faraday rotator for the wavelength equal to 1.31 $\mu$m was fabricated.

When the internal crystal defects, Faraday rotational capacity, insertion loss, a temperature characteristic and extinction ratio were evaluated after this Faraday rotator was cut into 3-mm square, no defect was confirmed in an observation by a polarization microscope using the infrared ray, and a Faraday rotational coefficient of 0.225 deg./$\mu$m, a maximum insertion loss of 0.03 dB, a minimum insertion loss of 0.01 dB, a temperature characteristic of 0.063 deg./°C./, a maximum extinction ratio of 45.5 dB and a minimum extinction ratio of 43.1 dB were obtained when a film thickness was equal to 200 $\mu$m (refer to Table 2).

After materials which are $Yb_2O_3$ (weight: 8.434 g), $Gd_2O_3$ (weight: 5.300 g), $B_2O_3$ (weight: 43.214 g), $Fe_2O_3$ (weight: 144.84 g), PbO (weight: 1189.6 g), $Bi_2O_3$ (weight: 826.4 g) and $TiO_2$ (weight: 1.810 g) were filled in a crucible made of Pt, fused at approximately 1000° C., stirred and homogenized, the temperature was reduced at 120° C./h and stabilized in a super saturation state at 804° C. Then, while a (Ca, Mg, Zr)-substituted GGG single crystal substrate having a diameter equal to 2 inches was rotated at 100 r.p.m., the magnetic garnet single crystal film was epitaxially grown and the single crystal film which is equal to 355 $\mu$m in film thickness was obtained.

The surface of this magnetic garnet single crystal film was turbid, and when the number of crystal defects on the surface was evaluated, 166 crystal defects were confirmed on the single crystal film having a diameter equal to 2 inches and no crack was generated on the single crystal film. When the composition of the single crystal film obtained by a fluorescent X-ray method was analyzed, the composition was $Bi_{1.30}Gd_{0.90}Yb_{0.76}Pb_{0.04}Fe_{4.96}Pt_{0.01}Ti_{0.03}O_{12}$. Further, this magnetic garnet single crystal film was polished by light having a wavelength of 1.31 $\mu$m so that a Faraday rotational angle was 45 deg., non-reflective films were attached on both surfaces, and the Faraday rotator for the wavelength equal to 1.31 $\mu$m was fabricated.

When the internal crystal defects, Faraday rotational coefficient, insertion losses, a temperature characteristic and extinction ratios were evaluated after this Faraday rotator was cut into 3-mm squares, one or two defects were confirmed in the observation by a polarization microscope using the infrared ray, and a Faraday rotational coefficient of 0.225 deg./$\mu$m, a maximum insertion loss of 0.04 dB, a minimum insertion loss of 0.02 dB, a temperature characteristic of 0.063 deg./°C./, a maximum extinction ratio of 38.9 dB and a minimum extinction ratio of 36.9 dB were obtained when a film thickness was equal to 200 $\mu$m (refer to Table 2).

As described above, according to the present invention, the magnetic garnet which is not only low in light absorption loss but also low in crystal defect can be obtained. Further, the Faraday rotator having a high extinction ratio can be steadily obtained.

TABLE 1

Composition and evaluation results of Bi-substituted rare earth iron garnet sinqle crystal film

| | Composition | Number of defects (pcs) | Insertion loss (dB) | Extinction ratio (dB) |
|---|---|---|---|---|
| Example 1 | $Bi_{1.12}Gd_{1.15}Yb_{0.69}Pb_{0.04}Fe_{4.96}Pt_{0.04}O_{12}$ | 10 | 0.01~0.05 | 42.1~45.6 |
| Example 2 | $Bi_{1.12}Gd_{1.15}Yb_{0.69}Pb_{0.04}Fe_{4.98}Pt_{0.02}O_{12}$ | 15 | 0.06~0.10 | 41.6~44.9 |
| Example 3 | $Bi_{1.16}Gd_{1.08}Yb_{0.72}Pb_{0.04}Fe_{4.97}Pt_{0.03}O_{12}$ | 18 | 0.03~0.07 | 41.9~45.6 |
| Example 4 | $Bi_{1.30}Gd_{0.90}Yb_{0.76}Pb_{0.04}Fe_{4.96}Pt_{0.04}O_{12}$ | 10 | 0.01~0.04 | 42.1~45.7 |
| Comparative Example | $Bi_{1.30}Gd_{0.90}Yb_{0.76}Pb_{0.04}Fe_{4.96}Pt_{0.01}Ti_{0.03}O_{12}$ | 166 | 0.02~0.04 | 36.9~38.9 |

TABLE 2

Composition and evaluation results of Bi-substituted rare earth iron garnet single crystal film

| | Composition | Number of defects (pcs) | Insertion loss (dB) | Extinction ratio (dB) |
|---|---|---|---|---|
| Example 5 | $Bi_{1.12}Gd_{1.15}Yb_{0.69}Pb_{0.04}Fe_{4.96}Pt_{0.01}Ge_{0.03}O_{12}$ | 12 | 0.01~0.05 | 42.0~45.1 |
| Example 6 | $Bi_{0.80}Tb_{2.16}Pb_{0.04}Fe_{4.96}Pt_{0.01}Ge_{0.03}O_{12}$ | 15 | 0.02~0.05 | 42.8~45.8 |
| Example 7 | $Bi_{1.30}Gd_{0.90}Yb_{0.76}Pb_{0.04}Fe_{4.96}Pt_{0.01}Ge_{0.03}O_{12}$ | 10 | 0.01~0.03 | 43.1~45.5 |
| Comparative Example | $Bi_{1.30}Gd_{0.90}Yb_{0.76}Pb_{0.04}Fe_{4.96}Pt_{0.01}Ti_{0.03}O_{12}$ | 166 | 0.02~0.04 | 36.9~38.9 |

What is claimed is:

1. A magnetic garnet single crystal grown by a liquid-phase epitaxial growth method and having the general formula represented by $$Bi_aPb_bA_{3-a-b}Fe_{5-c-d}B_cPt_dO_{12}$$

wherein A is at least one kind of element selected from Y, La, Ce, Pr, Nd, Sm, Eu, Gd, Tb, Dy, Ho, Er, Tm, Yb and Lu, B is at least one kind of element selected from Ga, Al, Sc, Ge and Si, and a, b, c and d are represented by $0.8<a<1.4$, $0<b\leqq 2.0$, $0\leqq c\leqq 0.9$ and $0<d\leqq 2.0$ respectively.

2. The magnetic garnet single crystal as set forth in claim 1, further having a film thickness of more than 200 $\mu$m.

3. The magnetic garnet single crystal as set forth in claim 2, wherein b/d is represented by $0.5\leqq b/d\leqq 2.0$.

4. A magnetic garnet single crystal grown by a liquid-phase epitaxial growth method and having general formula represented by $$Bi_aPb_bA_{3-a-b}Fe_{5-c-d}B_cGe_dO_{12}$$

wherein A is at least one kind of element selected from Y, La, Ce, Pr, Nd, Sm, Eu, Gd, Tb, Dy, Ho, Er, Tm, Yb and Lu, B is at least one kind of element selected from Ga, Al, Sc, Pt and Si, and a, b, c and d are represented by $0<a<3.0$, $0<b\leqq 2.0$, $0\leqq c\leqq 2.0$ and $0<d\leqq 2.0$ respectively.

5. The magnetic garnet single crystal as set forth in claim 4, further having a film thickness of more than 200 $\mu$m.

6. A Faraday rotator formed from the magnetic garnet single crystal in claim 1.

7. The Faraday rotator as set forth in claim 6, further having an insertion loss of less than 0.1 dB.

8. A Faraday rotator formed from the magnetic garnet single crystal in claim 2.

9. A Faraday rotator formed from the magnetic garnet single crystal in claim 3.

10. A Faraday rotator formed from the magnetic garnet single crystal in claim 4.

11. A Faraday rotator formed from the magnetic garnet single crystal in claim 5.

* * * * *

UNITED STATES PATENT AND TRADEMARK OFFICE

CERTIFICATE OF CORRECTION

PATENT NO. : 6,641,751 B1
DATED : November 4, 2003
INVENTOR(S) : Atsushi Ooido et al.

It is certified that error appears in the above-identified patent and that said Letters Patent is hereby corrected as shown below:

Title page,
Item [73], Assignee, should read:
-- [73] Assignee: TDK Corporation, Tokyo (JP) --

Signed and Sealed this

Seventeenth Day of February, 2004

JON W. DUDAS
*Acting Director of the United States Patent and Trademark Office*